United States Patent [19]

Stahlecker

[11] 4,173,114

[45] Nov. 6, 1979

[54] OPEN-END SPINNING MACHINE WITH A PLURALITY OF SPINNING ASSEMBLIES AND AT LEAST ONE MOBILE SERVICING DEVICE

[75] Inventor: Fritz Stahlecker, Josef-Neidhart-Strasse 18, 7341 Bad Überkingen, Fed. Rep. of Germany

[73] Assignees: Fritz Stahlecker; Hans Stahlecker, both of Fed. Rep. of Germany

[21] Appl. No.: 884,572

[22] Filed: Mar. 8, 1978

[30] Foreign Application Priority Data

Mar. 15, 1977 [DE] Fed. Rep. of Germany ..... 2711163

[51] Int. Cl.[2] ..... D01H 15/00; D01H 13/14

[52] U.S. Cl. ..... 57/263

[58] Field of Search ..... 57/34 R, 53, 78, 80, 57/58.89–58.95, 263

[56] References Cited

U.S. PATENT DOCUMENTS

| | | | |
|---|---|---|---|
| 3,892,062 | 7/1975 | Stahlecker | 57/263 |
| 3,935,699 | 2/1976 | Iida et al. | 57/53 X |
| 3,990,221 | 11/1976 | Stahlecker | 57/34 R |
| 3,990,221 | 11/1976 | Stahlecker | 57/263 |
| 4,055,936 | 11/1977 | Raasch | 57/34 R |
| 4,060,963 | 12/1977 | Stahlecker et al. | 57/58.89 X |
| 4,125,990 | 11/1978 | Stahlecker et al. | 57/263 |

*Primary Examiner*—Donald Watkins
*Attorney, Agent, or Firm*—Craig and Antonelli

[57] ABSTRACT

Open-end spinning machine apparatus is provided which includes a plurality of open-end spinning assemblies disposed adjacent one another and a mobile servicing device for selectively performing servicing operations at respective ones of the spinning assemblies. To accommodate precise alignment of servicing instruments of the mobile servicing device with the part or parts being operated on at the individual spinning assemblies, aligning elements are provided at and carried by the servicing instrument, which aligning elements are precisely positioned with respect to the respective servicing instruments, and are engageable with guide elements at the respective spinning assemblies to precisely locate the servicing instrument with respect to the parts being operated on.

9 Claims, 10 Drawing Figures

OPEN-END SPINNING MACHINE WITH A PLURALITY OF SPINNING ASSEMBLIES AND AT LEAST ONE MOBILE SERVICING DEVICE

BACKGROUND AND SUMMARY OF THE INVENTION

The invention concerns an open-end spinning machine with a plurality of spinning assemblies disposed next to each other, and with at least one servicing device traveling on a track and capable of being presented to a spinning assembly in need of servicing. The servicing device has at least one servicing instrument or member that is presentable to a structural part of the spinning assembly requiring servicing, for execution of a servicing operation.

It is known that open-end spinning machines may be equipped with mobile servicing devices which execute a partly or fully automatic piecing, cleaning, spool exchange or yarn check. Depending upon the given conditions, the necessary servicing instruments are combined in a single servicing device, or are disposed as a plurality of separately mobile part devices. Since the individual servicing operations, particularly the piecing operation, require that quite specific conditions and spatial relationships be respected, it is necessary that the servicing instruments be presented with great precision to the structural parts of the spinning assembly in question that are to be serviced, so that as far as possible uniform conditions will obtain.

It is known (U.S. Pat. No. 3,990,221 corresponding to German OS No. 2,454,900) that the track for the servicing device can be built in such a way that the servicing device will assume an exactly defined position at each spinning assembly. For this the rails must be made in a special way, and they have to be adjusted. The assembling and adjustment of the rails is a very time-consuming operation. Moreover, that is the risk that after a certain operating time there will be deformations or the like, so that the precision will be lost. Adjustment then has to be repeated on the machine installed in the mill. Moreover, in constructions of this kind, it is only possible exactly to align one respective part of the spinning assembly with a servicing instrument of the servicing device. If the servicing device has a plurality of servicing instruments or members that are presented to different structural parts of the spinning assembly, there are more difficulties that can only be mastered by a very precise maintenance of manufacturing and assembly tolerances, both of the spinning assembly and of the servicing device.

The invention is intended to create an open-end spinning machine of the specified type in which there is no need for such close tolerances in presentation of the individual servicing instruments or members to the structural parts to be serviced, in the spinning assembly. This problem is solved in that each servicing instrument is provided with an aligning element that, in presentation of the servicing instrument to the structural part of the spinning assembly that requires servicing, will engage a guide element disposed fixedly in an adjustable position with reference to the structural part, on the spinning assembly or on the machine frame.

In this arrangement it is provided that each servicing instrument will be centered on this structural part by means of the aligning elements and the guide elements in presentation to the part that is to be serviced, so that thereby the effect of inaccuracies in assembling and/or manufacture will be offset. There is the advantage that each servicing instrument or member that cooperates with a structural part of the spinning assembly can be precisely aligned so that also the disposition of the servicing instruments and member inside the servicing device and the disposition of the individual structural parts in the spinning assembly can be managed without excessively close tolerances. Adjustment of the guide elements can be undertaken easily with use of appropriate templates in the manufacturing plant. This adjustment, in assembling the open-end spinning machine at the mill, is not intended to be further changed. However, according to preferred contemplated embodiments it is possible without much effort to undertake a new precise adjustment if the machine is changed over, or if repairs are to be made.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
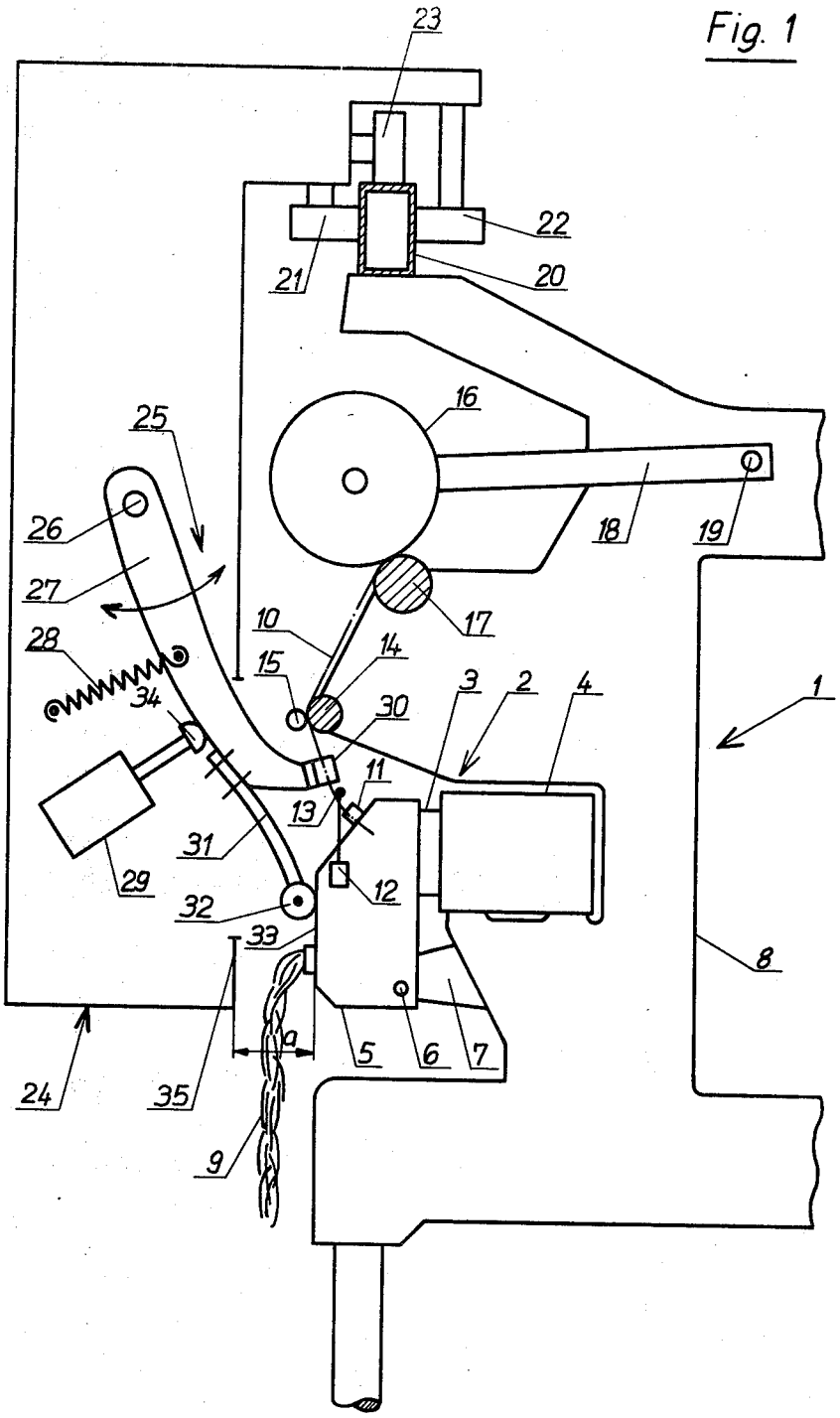
FIG. 1 is a partial sectional schematic view through an open-end spinning machine, with a lateral view of a mobile servicing device, constructed in accordance with a preferred embodiment of the invention.

Open-end spinning machine 1 which is schematically shown in cross section in FIG. 1 has an open-end spinning assembly 2, composed substantially of three housings 3, 4 and 5. A spinning rotor (not illustrated) is disposed in housing 3, its drive and bearing devices (also not illustrated) being disposed in housing 4. Housing 5 which contains the feed and opening devices (likewise not illustrated) can be swung down from housing part 3 about a stationary shaft 6, disposed on receiving means 7 of machine frame 8. The delivered sliver 9 is opened to individual fibers in a known way in open-end spinning assembly 2, spun and pulled off as spun yarn 10 (indicated with dot-and-dash line) from a yarn draw off passage 11. A yarn monitor switch 12 is associated with the running of yarn 10, and in a known way switches off the feed device (not illustrated). Yarn 10 is drawn off by draw off rolls 14, 15 and wound on a spool 16, which spool is driven by a friction roll 17. A spool holder 18, in which spool 16 is borne, is swingable about a shaft 19, so that the drive of spool 16 can be interrupted by lifting off of friction roll 17.

The machine frame 8 supports a rail 20 extending in the longitudinal direction of the machine, whereon by means of rollers 21, 22 and 23 of which at least one is driven, a servicing device 24 can be caused to travel along open-end spinning machine 1. Such servicing devices have a plurality of servicing organs, instruments or members, whereof in the example only one servicing instrument 25 is illustrated, by which the quality of drawn off yarn 10 is periodically checked. The servicing instrument 25, made as a yarn testing device which functions in a manner known per se in detecting quality of the yarn 10, has a swingable arm 27 that can be swung about a shaft 26 in the direction of the double arrow, said arm 27 being swingable against the action of a tension spring 28 of an actuating element made as a lifting piston magnet 29, in such a way that a yarn testing head 30 on the end of arm 27 will be presented to drawn off yarn 10.

To make possible a precise presentation of yarn testing head 30 to yarn 10, an aligning element 31 is fixed to arm 27, presenting a roller 32 at its free end. Said roller 32 in presentation of yarn testing head 30 bears against the frontal surface 33 of housing 5, whereby the pressure of lift piston 34 of piston magnet 29 moves arm 27 until roller 32 comes into application on surface 33. Since yarn draw off passage 11 is always precisely adjusted with reference to surface 33 of housing 5, it is ensured in this way that yarn testing head 30 will be presented precisely to yarn 10. We see that mobile servicing device 24 does not require lower rails, stably to guide the servicing instrument. It is not important, what the exact distance a between front 35 of mobile servicing instrument 24 and surface 33 of housing 5 of open spinning assembly 2 may be. This distance a may assume different values, within certain limits, depending upon the tolerances of mobile servicing device 24 or rail 20. However, it is ensured by means of aligning elements 31, 32 that yarn testing head 30 of servicing device 25 will be presented to yarn 10 in a precisely defined, reproducible way. If there is risk of deviations in the longitudinal direction of the machine, lateral guide elements (not illustrated) can be disposed on surface 33 of housing 5, which will center yarn testing head 30 in the middle of yarn draw off passage 11, and therewith the middle of yarn 10. The necessary mobility of yarn testing head 30 in the longitudinal direction of the machine is producible by a suitably selected elastic resilience of the swing arm, or by springing retention of shaft 26.

Figure 2:
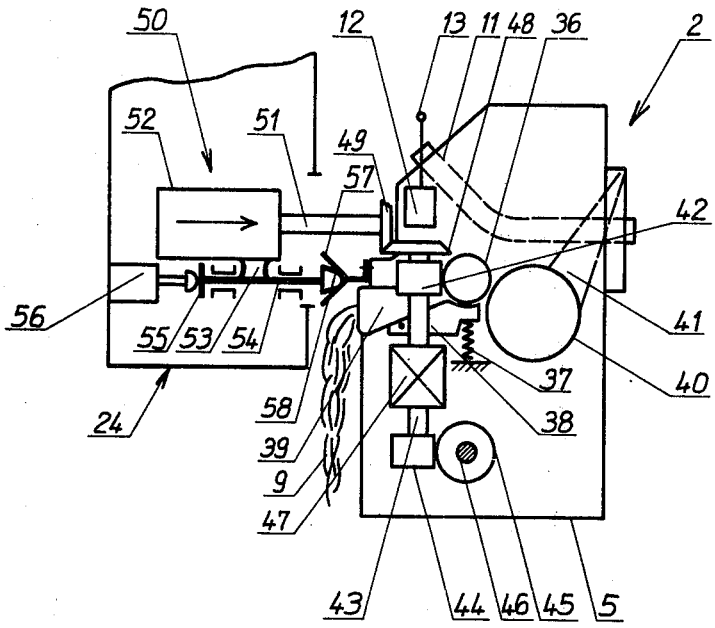
FIG. 2 is a partial sectional schematic view through a spinning assembly of an open-end spinning machine, and through a mobile servicing device constructed in accordance with another preferred embodiment of the invention.

In FIG. 2 the cross section through an open-end spinning assembly 2 is schematically shown. Of this assembly, only housing 5 that bears the feed and opening devices is shown. A servicing device 24 is moved to spinning assembly 2 and there executes servicing operations on the sliver feed. The feed device of spinning assembly 2 has a feed roll 36 which cooperates with a feed table 38 that is under pressure from spring 37. Sliver 9 runs into an intake hopper 39, is clamped in a nip formed between feed roll 36 and feed table 38, and presents a beard to a fast running opening roll 40. The individual fibers teased from the beard by opening roll 40 are fed via a feed passage 41 to a spinning rotor that is not illustrated in FIG. 2. The drawing off of the spun yarn is effected via a yarn draw off passage 11, with which the yarn sensor 13 of a yarn monitor 12 is associated. The drive of feed roll 36 is effected via a helical gear 42 engaging in a corresponding toothed arrangement of feed roll 36, said gear 42 being disposed on an upright shaft 43. The drive of shaft 43 is effected via a pair of helical gears 44, 45, of which the latter is disposed on a drive shaft 46 extending in the longitudinal direction of the machine. The drive transmission can be interrupted in the region of shaft 43 by an electromagnetic coupling 47 that divides the said shaft; the coupling is associated in a known way with yarn monitor 12, and in case of a yarn break it switches off the feed of sliver 9 by stopping feed roll 36.

Upright shaft 43 for the drive of feed roll 36 has a bevel gear 48 at its upper end with which a bevel gear 49 of mobile servicing device 24 can be brought into engagement. This bevel gear 49 is part of a servicing instrument or organ 50 with which, when the sliver feed of spinning assembly 2 has been cut off, for example during a piecing operation, the feed of sliver 9 can be executed by mobile servicing device 24. Bevel gear 49 is disposed on a shaft 51 which is connected with a motor 52 of mobile servicing instrument 24. Motor 52 is connected via a retaining device 53 with a rod 54 which presents a pressure piece 55 at one end, against which the piston of a lifting piston magnet 56 can press, counter to the pressure of a recall spring (not illustrated). In this way it is possible, with actuation of magnet 56 to shift motor 52 and therewith bevel gear 49 in toward spinning assembly 2, so that bevel gear 49 can temporarily engage bevel gear 48. It is clear that precise spatial relationships must be maintained for gears 48, 49. For this reason housing 5 presents a centering cone 57 as guide element, against which a pressure piece 58 of rod 54 of mobile servicing device 24 can bear. The centering cone is precisely adjustably positioned with respect to bevel gear 48 of the spinning assembly. Pressure piece 58 penetrates into centering cone 57 and thereby aligns servicing instrument 50 with reference to gear 48. The guides in which rod 54 is guided in servicing device 24 must allow the aligning movements. Thereby for instance it is provided that the guide sleeves surrounding the rod will be held with radial compression springs. In practice it is also advantageous if the pressure piece penetrates with a cylindrical stud into a corresponding recess of the centering cone, in order to be able to offset angular deviations also.

Figure 3:
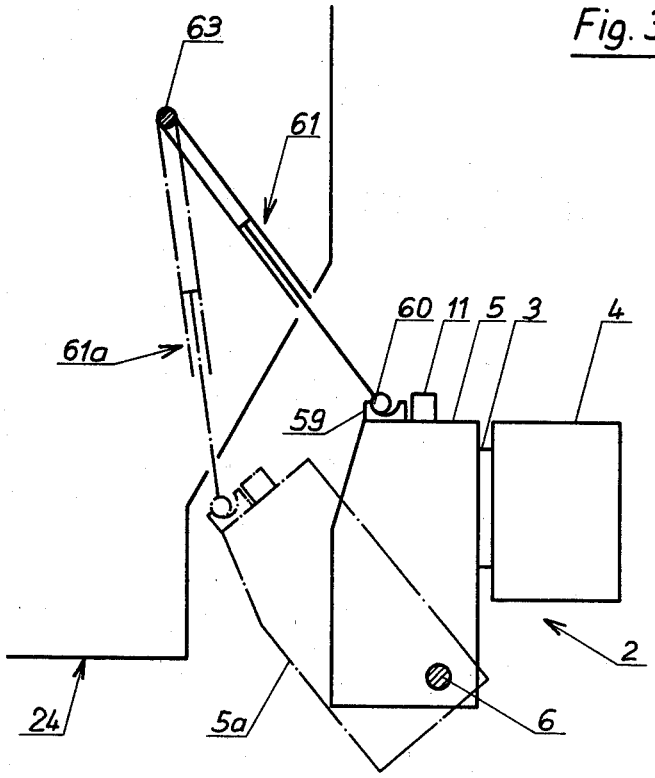
FIG. 3 is a lateral schematic view of an open-end spinning assembly and a partial sectional schematic view through a mobile servicing instrument, constructed in accordance with another preferred embodiment of the invention.

In FIG. 3, housings 3, 4 and 5 of an open-end spinning assembly 2 are schematically shown in a lateral view. Housing 5 can be swung down about stationary shaft 6, into position 5*a* which is indicated with dot-and-dash lines. In this way, a spinning rotor which is not illustrated in FIG. 3 can be exposed for servicing purposes. In the region of yarn draw off passage 11, housing 5 presents a ball guide element 59 in which a ball 60 servicing as aligning element, of an advantageously pneumatic piston cylinder unit, engages an actuating mechanism 61 which constitutes a servicing instrument or organ. Actuating mechanism 61 is rotatable about a shaft 63, by means of a drive (not illustrated), whereby it makes possible the springing resilience of the piston cylinder unit, to remove ball 60 to different distances from rotating shaft 63. The piston-cylinder unit, shown with opened housing part 5*a*, is designated 61*a*. If ball guide element 59 is relatively large, it is not necessary to align mobile servicing device 24 itself with reference to spinning assembly 2.

Figure 4:
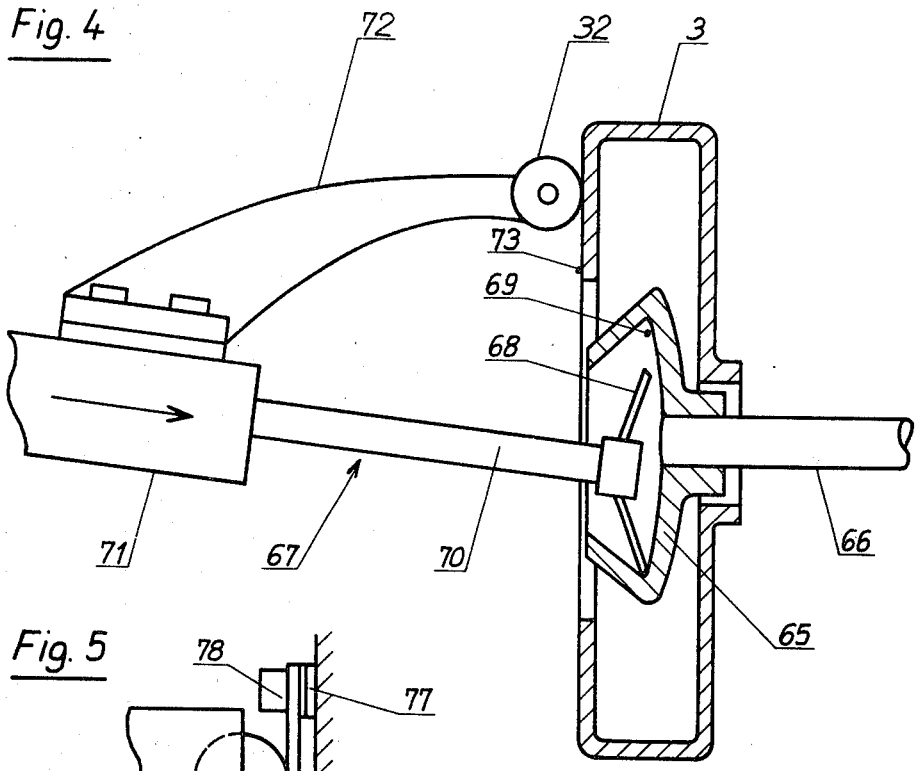
FIG. 4 is an enlarged part sectional detail view of a portion of an open-end spinning assembly, and a view of a detail of a servicing instrument, constructed in accordance with another embodiment of the invention.

In FIG. 4, housing 3 is shown in cross section, said housing 3 accepting a spinning rotor 65 whose shaft 66 is taken through an aperture in the rear wall of housing 3 and borne in a way that is not illustrated. After removal of housing 5 (housing 5 not shown in FIG. 4, but positioned relative to housing 3 as shown in FIGS. 1 to 3), a cleaning device 67 is presented as servicing instrument or organ of a servicing device (not illustrated) to spinning rotor 65. Cleaning device 67 cleans the fiber collecting groove 69 of spinning rotor 65 with a cleaning element made as a scraper 68. Scraper 68 is seated on a drivable shaft 70, whose retaining device 71 is selectively presentable in the direction of the arrow to housing part 3. After completion of the servicing operation, cleaning element 68 is withdrawn again from the interior of spinning rotor 65. On the retaining device 71 of cleaning device 68 there is flanged a bracing lever 72 which serves as an aligning element, presenting a roller 32 at its free end, which roller 32 is applied against the front surface 73 of housing 3, acting as a guide element. This arrangement has the advantage that the distance between cleaning element 68 and spinning rotor 65 can be retained even if roller 32 executes slight upward or downward movements on surface 73 because the spinning rotor 65 in its housing 3 will assume a position that is to be held precisely, at all spinning assemblies.

The form of the guide elements of spinning assemblies 2 and of the aligning elements of the servicing instruments or organs of servicing device 24 depends upon the type of deviations that may be anticipated. The simplest configuration, in the form of stops, can be provided if only a deviation in the direction of the motion of presentation of the servicing instrument is to be expected, or if it is only this deviation that is important for the work of the servicing device. If in addition a shaft in the vertical and/or horizontal direction is to be expected, or to be excluded in order to get acceptable operation, then the guide elements and/or the aligning elements must be such that they will guide the servicing instrument to a quite specific point determined by the position of the structural part of the spinning assembly that is to be serviced. The servicing instruments/organs and/or their moving and actuating elements must then be such that their retaining devices or bearings will allow aligning movements in the possible directions, within the limits of the tolerances of the arrangements of the structural parts. In many cases the intrinsic elastic deformability is sufficient, and this may be enhanced by supplementary structural arrangements. The guide elements of the spinning assemblies, which are stationary after their adjustment, can retain the position as set at the manufacturing plant, because their position relative to the appurtenant parts that are to be serviced is not changed by assembly of the machine. On the other hand, they can be readily readjusted in case this should be necessary because of changeover of the machine, or after assembly.

Figure 5:
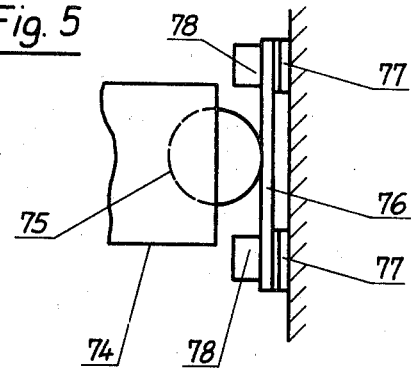
FIGS. 5 to 8 are enlarted views showing details of aligning elements of mobile servicing devices and appurtenant guide elements of the spinning assembly, constructed in accordance with respective preferred embodiments of the invention

FIG. 5 shows the free end of an arm 74 which is associated with a servicing instrument of some configuration, of a mobile servicing device, and serves as an aligning element. At its end, arm 74 accepts a ball 75 that bears against a guide element 76 of the spinning assembly (not illustrated). Guide element 76 is a plate that is fixed on the spinning assembly, with interposition of spacers 77, by bolts 78. With this stop, the movement of presentation of a servicing organ can be exactly determined.

Figure 6:
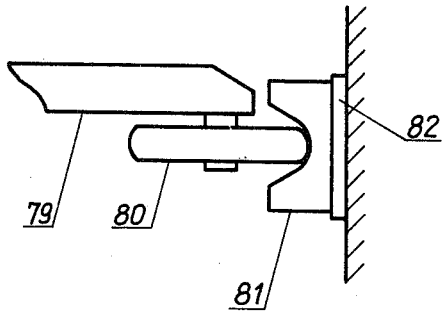

In the embodiment of FIG. 6, the free end of an arm 79 which also belongs to a servicing instrument of some configuration, of a mobile servicing device, presents a wheel 80 that can be introduced into a more or less V-shaped centering guide 81 of a spinning assembly (not illustrated) and brace itself there. In this case also, the distances that are required in the particular situation can be precisely adjusted by calibration sheet 82. Such an arrangement is advantageous if a limitation of the presenting movement is to be retained, and a deviation in a transverse plane excluded. This form could also be used for a servicing organ which, after its presentation to a structural part of the spinning assembly, executes a movement in a given direction which then is determined by the rail-like, preferably curved centering guide 81.

Figure 7:
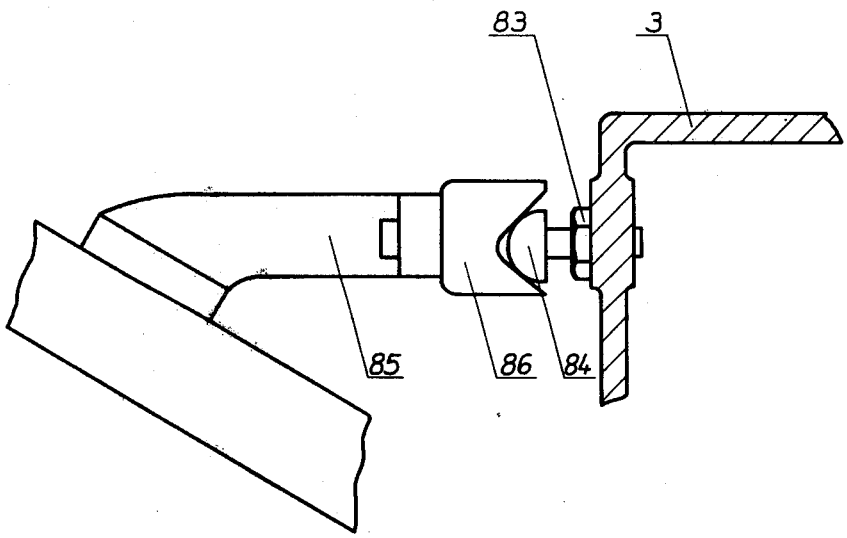

FIG. 7 shows a part sectional view of a housing 3 of a spinning assembly, which bears a ball head 84 as guide element, adjustable by a bolt connection 83. A V-shaped or round counterpiece 86 belonging to an aligning element 85 of any servicing instrument of a mobile servicing device can bear against ball head 84, thereby being centered in the transverse direction, or given a punctate centering. Counterpiece 86 can be adjustable or exchangeable.

Figure 8:
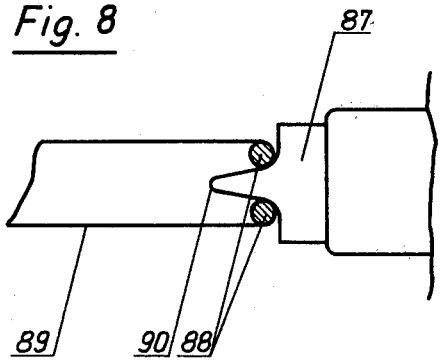

In FIG. 8 finally, a bearing means 87 associated with a spinning assembly and serving as guide element is shown, which has a tip 90 with guide surfaces, on which two pins 88 of an aligning element 89 associated with the mobile servicing device are centered in a transverse plane, and applied for limitation of the motion of presentation.

Figure 9:
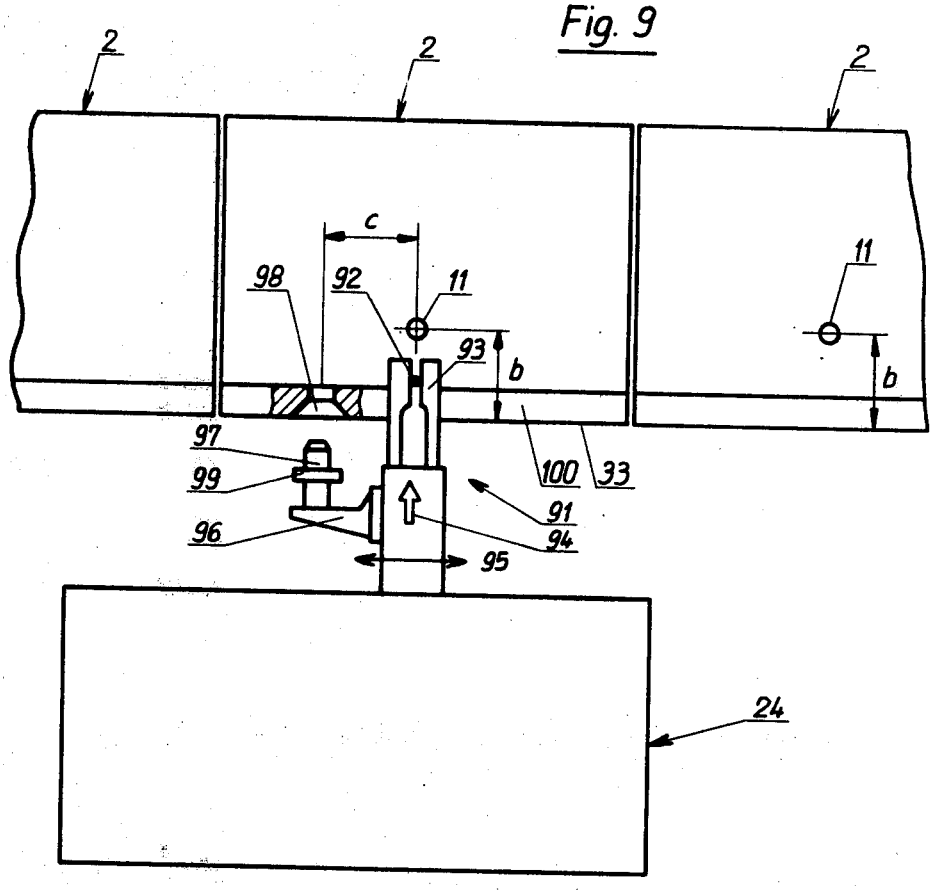
FIG. 9 is a top schematic view of a part of an open-end spinning machine and a mobile servicing instrument, constructed in accordance with preferred embodiments of the invention.

FIG. 9 shows a top view of three open-end spinning assemblies 2 arranged next to each other, on which in the selected illustration a mobile servicing device 24 is active. Mobile servicing device 24 includes as servicing instrument or organ a yarn transfer clamp 91 which is supposed to introduce a yarn 92 that is to be pieced into yarn draw off passage 11 of spinning assembly 2. It is necessary that yarn 92 reach a position exactly above the opening of yarn draw off passage 11, i.e. yarn transfer clamp 91 or its jaws 93 must be precisely directed with reference to yarn draw off passage 11. For this purpose, a retaining device 96 is disposed on yarn transfer clamp 91, which bears a centering finger 97 as aligning element. This centering finger 97 is moved together with jaws 93 in the direction of arrow 94 by a presenting mechanism (not illustrated). Thereby centering finger 97 penetrates into a centering bore 98 which serves as a guide element, said bore being disposed in an adjustable position with reference to yarn draw off passage 11 and presenting an entrance cone, by which centering finger 97 and the whole yarn transfer clamp 91 are centered. The centering finger presents a shoulder 99 which after introduction of centering finger 97 into centering bore 98 is applied against the frontal surface 33 of spinning assembly 2. As soon as this position is reached, yarn transfer clamp 91 is in its operating position, i.e. yarn 92 that is to be pieced is precisely over yarn draw off passage 11. To manage this, it is only necessary to set centering bore 98 and surface 33 of spinning assembly 2 with reference to draw off passage 11 (distances b and c), once, before putting into operation. No matter what deviations and tolerances there may be, from one spinning assembly to the next, or however much the travel track may bend, the yarn transfer clamp 91 will always be pecisely aligned with reference to the yarn draw off passage 11 of any spinning assembly. Because transfer clamp 91, as a consequence of joint play, will have a certain amount of lateral play in the direction of double arrow 95, clamp 91 can also be centered by centering bore 98.

Figure 10:
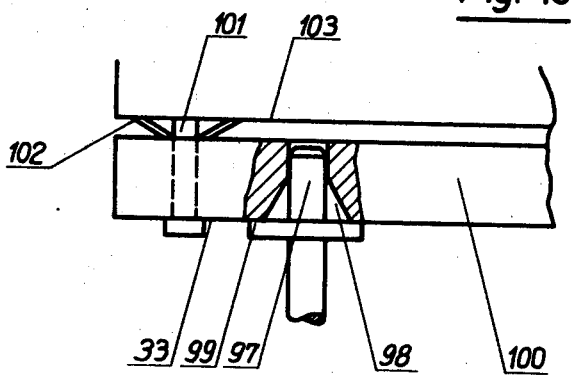
FIG. 10 is an enlarged view of a detail of FIG. 9, in another operating position.

In FIG. 10, centering bore 98, together with centering finger 97 which has already been introduced, is shown on a somewhat larger scale. We see that shoulder 99 of centering finger 97 has been applied to frontal surface 33 of the spinning assembly. The spinning assembly on its front face has a strip 100 which contains centering bore 98 and which is adjusted with respect to the actual spinning assembly 103, at distance b from yarn draw off passage 11, by set screws 101, possibly with addition of base 102. With suitable long slots, distance c can likewise be set precisely.

Such centering bores 98 with strip 100 can be placed at any location on spinning assembly 2 and also on machine frame 8. In cooperation with the cylindrical or possibly slightly conical centering, there can be not only exact presentation to a point but also alignment with reference to an angular position of the servicing organ and the structural part that is to be serviced.

It is also contemplated—still holding to basic principles of the invention—that individual parts, or all parts of the spinning assembly, could be disposed flexibly, cooperating with parts of the servicing instrument. Here also it would be possible to effect automatic alignment in presentation.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Open-end spinning machine apparatus comprising:

a plurality of spinning assemblies disposed adjacent one another, and a mobile servicing device which is movable to respective servicing positions adjacent respective ones of said spinning assemblies, said mobile servicing device including a servicing instrument engageable with a structural part of a spinning assembly during servicing operations, wherein said servicing instrument is provided with an aligning element which is positioned in a predetermined position with respect to said servicing instrument, wherein at least one of said spinning assemblies is provided with a guide element, said guide element being adjustably positioned in a predetermined position with respect to said structural parts, wherein said aligning element of said servicing instrument is engageable with said guide elements at said spinning assembly to assure precise positioning of said servicing instrument with respect to said structural parts during servicing operations, and wherein said servicing instrument is movable with respect to said mobile servicing device, and wherein said aligning element is connected to and carried with said servicing instrument.

2. Open-end spinning machine apparatus comprising:

a plurality of spinning assemblies disposed adjacent one another, and a mobile servicing device which is movable to respective servicing positions adjacent respective ones of said spinning assemblies, said mobile servicing device including a servicing instrument engageable with a structural part of a spinning assembly during servicing operations, wherein said servicing instrument is provided with an aligning element which is positioned in a predetermined position with respect to said servicing instrument, wherein at least one of said spinning assemblies is provided with a guide element, said guide element being adjustably positioned in a predetermined position with respect to said structural parts, wherein said aligning element of said servicing instrument is engageable with said guide element at said spinning assembly to assure precise positioning of said servicing instrument with respect to said structural parts during servicing operations, and wherein resilient retaining means are provided for resiliently holding said servicing instrument so as to be springingly movable with respect to said mobile servicing device.

3. Apparatus according to claim 1, wherein the structural part that is to be serviced is itself made as a guide element on which the aligning element engages.

4. Apparatus according to claim 1, wherein a structural part of the spinning assembly serves as a guide element, disposed in a given arrangement with reference to the structural part that is to be serviced.

5. Apparatus according to claim 1, wherein the guide element is made as a stop that limits the motion of presentation of the servicing instrument of the servicing device.

6. Apparatus according to claim 1, wherein the guide elements of the spinning assembly and the aligning element of the servicing instrument of the servicing device present elements that can be insertably engaged with each other, whereof one is made as a finger and the other as a centering bore which has a centering cone ahead of it.

7. Apparatus according to claim 1, wherein each of said spinning assemblies is provided with one of said guide elements for selective engagement by said aligning element of said servicing instrument.

8. Open-end spinning machine apparatus comprising:

a plurality of spinning assemblies disposed adjacent one another, and a mobile servicing device which is movable to respective servicing positions adjacent respective ones of said spinning assemblies, said mobile servicing device including a servicing instrument engageable with a structural part of a spinning assembly during servicing operations, wherein said servicing instrument is provided with an aligning element which is positioned in a predetermined position with respect to said servicing instrument, wherein at least one of said spinning assemblies is provided with a guide element, said guide element being adjustably positioned in a predetermined position with respect to said structural parts, wherein said aligning element of said servicing instrument is engageable with said guide element at said spinning assembly to assure precise positioning of said servicing instrument with respect to said structural parts during servicing operations, and wherein a plurality of servicing instruments are carried by said mobile servicing device, and wherein aligning elements are provided for each of said servicing instruments.

9. Open-end spinning machine apparatus comprising:

a plurality of spinning assemblies disposed adjacent one another, and a mobile servicing device which is movable to respective servicing positions adjacent respective ones of said spinning assemblies, said mobile servicing device including a servicing instrument engageable with a structural part of a spinning assembly during servicing operations, wherein said servicing instrument is provided with an aligning element which is positioned in a predetermined position with respect to said servicing instrument, wherein at least one of said spinning assemblies is provided with a guide element, said guide element being adjustably positioned in a predetermined position with respect to said structural parts, wherein said aligning element of said servicing instrument is engageable with said guide element at said spinning assembly to assure precise positioning of said servicing instrument with respect to said structural parts during servicing operations, and wherein said aligning element is attached to said servicing instrument by adjustable spacer means.

* * * * *